US005497516A

United States Patent [19]

Irwin

[11] Patent Number: 5,497,516

[45] Date of Patent: Mar. 12, 1996

[54] DRAIN SEALING APPARATUS

[75] Inventor: Lawrence F. Irwin, Sylmar, Calif.

[73] Assignee: Augerscope, Inc., Sylmar, Calif.

[21] Appl. No.: 301,710

[22] Filed: Sep. 7, 1994

[51] Int. Cl.[6] ..... E03C 1/244

[52] U.S. Cl. ..... 4/694; 4/255.07; 220/247

[58] Field of Search ..... 4/255.01, 255.07, 4/694; 220/247

[56] References Cited

U.S. PATENT DOCUMENTS

| | | | |
|---|---|---|---|
| 213,862 | 4/1879 | Blunt | 4/694 |
| 2,036,614 | 4/1936 | Tharp | 4/255.07 |
| 5,004,119 | 4/1991 | Irwin | 4/255.07 X |

*Primary Examiner*—Charles E. Phillips
*Attorney, Agent, or Firm*—J. E. Brunton

[57] ABSTRACT

An improved apparatus for temporarily sealing a vent or overflow aperture provided in the upper portion of a fixture such as a wash basin, sink, bathtub or bidet so that a pneumatic or hydraulic type sewer cleanout device can be used to clear a blockage located in a sewer line downstream of the fixture by generating fluid pressure within the sewer line intermediate the blockage and the main water drain of the fixture. The apparatus is of simple construction and embodies an assembly made up of a pressure plate, a threaded tube and a wing nut which can be threadably advanced along the tube to cause the pressure plate to sealably engage the apertured wall of the fixture.

2 Claims, 1 Drawing Sheet

DRAIN SEALING APPARATUS

BACKGROUND OF THE INVENTION

1. Field of the Invention

The present invention relates generally to devices for sealably closing vent apertures provided in the walls of various types of fixtures. More particularly, the invention concerns an improved device for use in temporarily sealing vents or overflow drains of the character typically provided in the upper wall portions of fixtures such as wash basins, sinks, bathtubs, and bidets.

2. Discussion of the Invention

In recent years several hydraulic and pneumatic devices have been developed for clearing blockages in drain lines by forcing fluids under pressure through the water outlet drain of the fixture. Such devices may force water or other liquids under pressure through the drain outlet, or they may be of the pneumatic impact or "air hammer" type which forces compressed air or other gases through the drain and into the sewer line.

Prior art cleanout devices of the aforementioned character lose their effectiveness when used with fixtures having a vent or overflow drain apertures. Such apertures are usually provided in the upper portions of the fixture and function to drain water from the fixture into the drain line connected to the drain outlet if the fixture is accidentally over filled. The overflow drain apertures are, of necessity, in communication with the sewer drain line which, in turn, is in communication with the fixture drain, or outlet. When a fluid pressure type cleanout device is used to clear a blockage in the drain line, the overflow apertures must be sealed. Otherwise the fluid forced through the fixture drain under pressure can flow outwardly through the overflow drain apertures before sufficient fluid pressure can be exerted against the blockage to open the line to normal water drainage from the fixture.

In many instances, the overflow apertures provided in a given fixture are in communication with an internal fluid passageway defined between inner and outer, spaced apart walls. The inner wall of the fixture typically defines the water reservoir while the outer wall defined the exterior surfaces of the fixture. Since, with this type of construction, the overflow apertures are accessible only from the inside of the fixture, effective sealing of the apertures can be difficult. For this reason, most types of prior art overflow drain seals involve the use of tapered plugs which can be inserted into the overflow apertures from the interior of the bowl of the fixture. However, such plugs are typically ineffective in sealing the overflow apertures against fluid pressure which is built up interiorly of the walls of the fixture by fluid pressure type cleanout tools. In instances of stubborn blockage of the sewer drain line, the cleanout tool will generate sufficient pressure within the internal passageway of the fixture to blowout the sealing plugs before clearing the blockage in the line. When this occurs the plugs, along with the backed-up fluid, can be ejected with a force that can cause serious personal injury and cause property damage.

One of the most effective prior art devices ever devised for sealing overflow drain apertures is that disclosed in U.S. Pat. No. 5,004,119 issued to the present inventor. This device includes a novel cam-like mechanism for urging a sealing member into sealing engagement with the fixture wall located adjacent the drain opening. The present invention constitutes an improvement of this earlier device in which the cam-like mechanism is replaced by a simpler and more positive threaded pressure imparting mechanism.

The thrust of the present invention is to provide an improved, easier-to-use and less complicated apparatus which can be employed to effectively seal overflow drain apertures provided in a given fixture against even substantial fluid pressures which may be generated against the sealing member of the apparatus by a pressure type sewer line cleanout tool.

SUMMARY OF THE INVENTION

It is an object of the present invention to provide an improved, easy-to-use, positively acting apparatus for effectively sealing vent and overflow drain apertures of the character provided in the inner wall of a dual wall bathtub, wash basin, sink or bidet, against fluid pressures generated in the overflow drain passageways of the fixture.

Another object of the invention is to provide an apparatus of the aforementioned character which can be used in conjunction with fluid pressure type sewer line cleanout tools to enable the tool to be effectively used to clear stoppages formed in the sewer drain line downstream from the main drain of the fixture.

Another object of the invention is to provide an apparatus as described in the preceding paragraphs which can be used with fixtures of widely varying shape and drain design.

Still another object of the invention is to provide an overflow drain dealing device which is of highly simple construction, is constructed from standard components and can be operated by unskilled persons without the need for any type of auxiliary tools.

Another object of the invention is to provide a vent sealing apparatus which is constructed from a minimum number of standard off-the-shelf type parts, and one which can be inexpensively manufactured.

DESCRIPTION OF THE INVENTION

Figure 1:
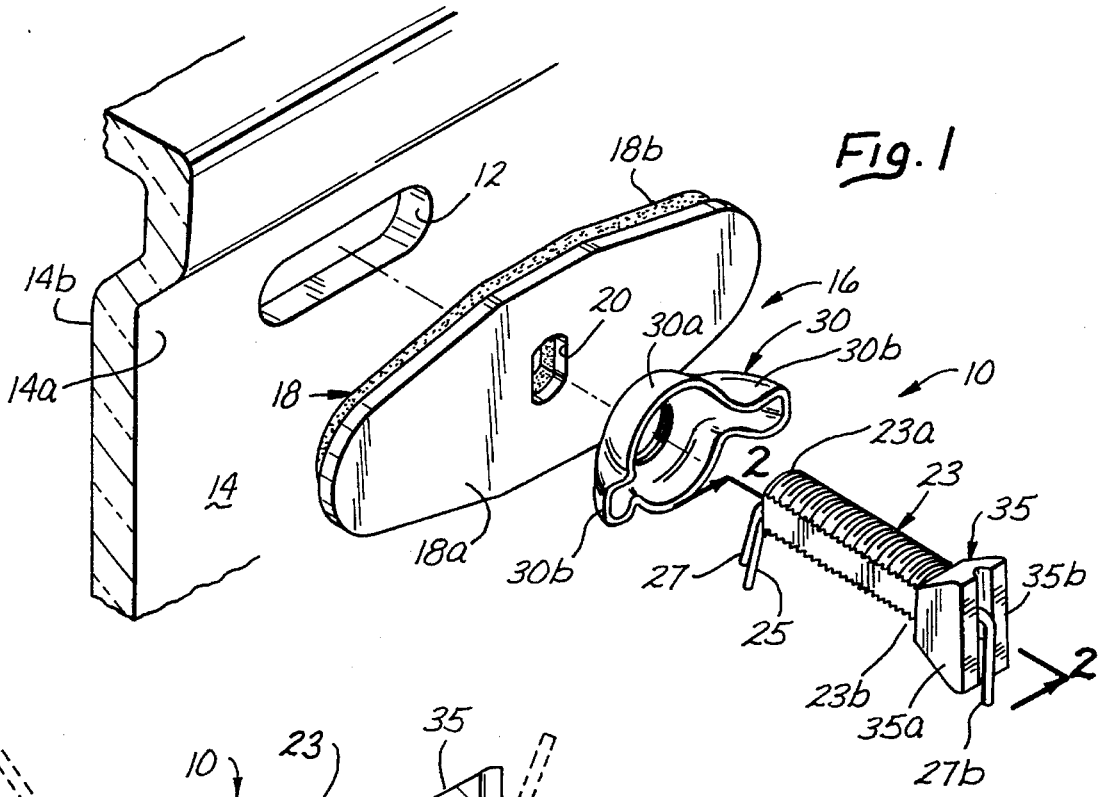
FIG. 1 is a generally perspective view of one form of the overflow drain sealing apparatus of the present invention.
Figure 2:
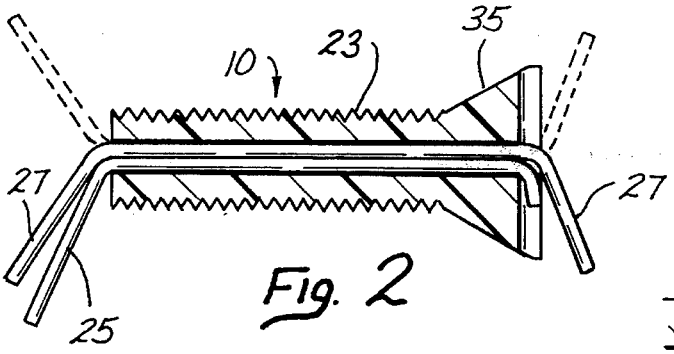
FIG. 2 is a cross-sectional view of the apparatus taken along lines 2—2 of FIG. 1.

Referring to the drawings and particularly to FIGS. 1 and 2, one form of the apparatus of the present invention is there shown and generally designated by the numeral 10. The apparatus is used for sealably closing an aperture 12 provided in a wall 14 having first and second surfaces 14*a* and 14*b*. As best seen in FIG. 1, the apparatus here comprises wall engaging means 16 for sealably engaging the first surface 14*a* of the wall 14 at a location surrounding aperture 12 and pressure imparting means operably associated with the wall engaging means for moving a sealing member 18 of the wall engaging means into sealable engagement with the first, or outer surface 14*a* of the wall. Sealing member 18 includes a first rigid surface 18*a* and a second, or rear, yieldably deformable surface 18*b* for engaging the front surface 14*a* of wall 14. An aperture 20 is provided proximate the center of sealing member 18, the purpose of which will presently be described.

In the instant form of the invention, the pressure imparting means comprises an elongated, externally threaded hollow tube 23; an elongated, first locking element 25 rotatably carried within tube 23; a second, elongated locking element 27 rotatably carried within tube 23 and sealing member engagement means threadably connected to tube 23 for engagement with sealing member 18 to urge the member into pressural engagement with the first or outer surface 14*a* of wall 14.

Figure 4:
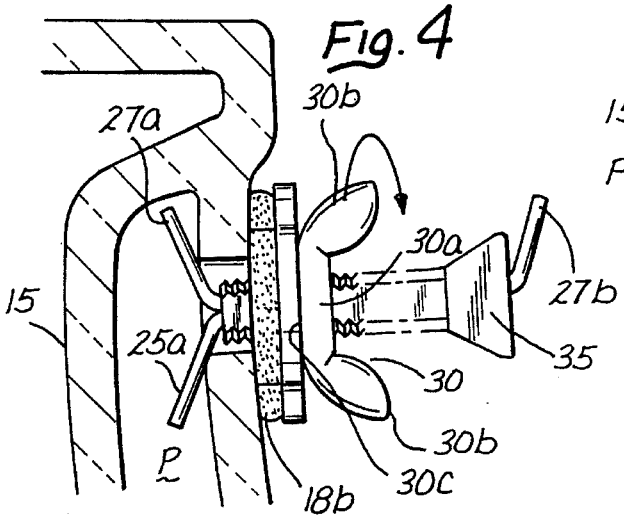
FIG. 4 is a side-elevational view similar to FIG. 3 but illustrating the appearance of the device in a locked, sealing position within the overflow drain.
Figure 3:
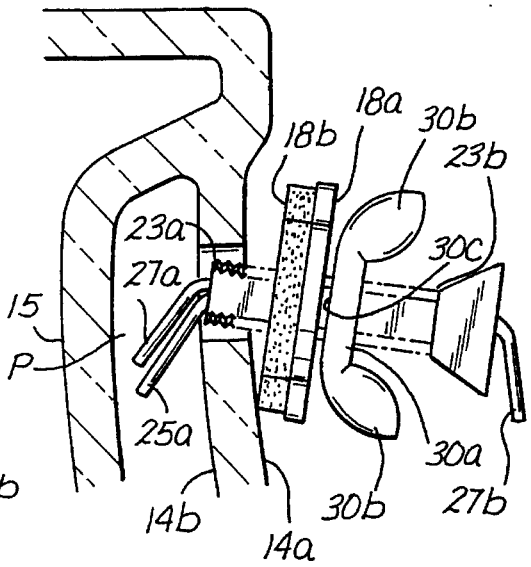
FIG. 3 is a side-elevational view illustrating the manner of insertion of the device into the overflow drain of a standard wash basin.

Referring to FIG. 3, it can be seen that first locking element 25 includes an outwardly and downwardly extending leg portion 25*a* which protrudes from the first end 23*a* of tube 23. When the apparatus of the invention is in position within the overflow or vent aperture 12 of the fixture as shown in FIG. 3, leg 25*a* is in engagement with the inner surface 14*b* of the wall 14. Locking element 27 also has an outwardly extending leg 27*a* provided proximate the forward end 23*a* of tube 23 and an outwardly extending leg 27*b* provided proximate end 23*b* of tube 23. Locking element 27 is rotatable within tube 23 from a first position as shown in FIGS. 1, 2, and 3, wherein leg 27*a* extends downwardly to a second position as shown in FIG. 4 wherein leg 27*a* extends angularly upwardly. When element 27 is in the first position, the locking elements along with the first end of tube 23 can be inserted through the aperture 20 formed in sealing member 18 and also through the aperture 12 formed in the fixture "F". This initial insertion step is illustrated in FIG. 3. Once the inboard end of the apparatus is in the position shown in FIG. 3, leg 27*b* is used to rotate locking element 27 to its second position as shown in FIG. 4 wherein leg 27*a* moves into locking engagement with the inner surface 14*b* of wall 14. As previously mentioned, the device of the invention is frequently used with dual wall fixtures having an overflow, or vent, passageway "P" defined between the inner wall 14 and an outer wall 15 of the fixture (FIGS. 3 and 4).

Once the locking leg 27*a* of the actuating means is rotated into the wall engaging position shown in FIG. 4, the pressure imparting means of the invention shown here as a wing nut 30, is threadably advanced along tube 23 into engagement with face 18*b* of sealing member 18. Continued advancement of the wing nut into pressural engagement with face 18*b* will urge surface 18*b* of member 18 into sealing engagement with the wall 14.

While in the form of the invention shown in the drawings, the pressure imparting means comprises wing nut 30 having an internally threaded hub portion 30*a* and diametrically opposed gripping wings 30*b*, it is to be understood that the pressure imparting means can comprise a nut or other type of alternately configured internally threaded member. Wing nut surface 30*c* is adapted to engage rigid surface 18*a* of sealing member 18 when the nut is threadably advanced along tube 23 so as to force face 18*b* of member 18 into sealing engagement with surface 14*a* in the manner shown in FIG. 4.

In operation of the device, a finger engaging portion 35, which is provided proximate the outboard end 23*b* of tube 23, is used to grip the device while in inboard end 23*a* of the tube is inserted into the aperture 12. After locking leg 27*a* is rotated from the position shown in FIG. 3 to the position shown in FIG. 4, wing nut 30 is threadably advanced along tube 30 to a point that surface 30*c* will engage the rigid surface 18*a* of sealing member 18. Continued rotation of the wing nut will cause the resiliently deformable surface portion 18*b* of member 18 to deform and securely, sealably engage the surface of face 14*a* of wall 14 which circumscribes aperture 12. With the apparatus in this locked position, aperture 12 is securely sealed against fluid flow in a direction through passageway "P" toward aperture 12. With aperture 12 being thusly sealed, fluid pressure exerted by the cleanout tool being used will be effectively directed against the blockage in the line so that the blockage can expeditiously be broken to allow normal flow of liquids through the drain lines.

Finger engaging portion 35, which comprises the finger gripping means of the invention, comprises a generally "V" shaped portion formed integrally with tube 23 and having opposing surfaces 35*a* and 35*b* for gripping engagement by the fingers of the user (FIG. 1).

When the blockage in the drain line has been cleared, the wing nut 30 is rotated in a counterclockwise direction from the position shown in FIG. 4 to the position shown in FIG. 3. Locking element 27 is then rotated so that end 27*a* extends downwardly in the manner shown in FIG. 3. With the apparatus in this configuration, the first end tube 23 can easily be removed from aperture 12 provided in wall 14.

Tube 23 as well as wing nut 30 can be constructed from any rigid, durable material such as metal or plastic. Locking members 25 and 27 are preferably constructed from metal rod, While various materials, such as rubber and other elastomerics, can be used to form portion 18*b* of sealing member 18.

Having now described the invention in detail in accordance with the requirements of the patent statutes, those skilled in this art will have no difficulty in making changes and modifications in the individual parts or their relative assembly in order to meet specific requirements or conditions. Such changes and modification may be made without departing from the scope and spirit of the invention, as set forth in the following claims.

I claim

1. An apparatus for sealably closing an aperture provided in a wall having spaced-apart first and second surface, comprising:

(a) wall engaging means for sealably engaging the first surface of the wall at a location surrounding the aperture, said wall engaging means comprising a sealing member having an aperture therethrough and including a first rigid surface and a second yieldably deformable surface for engagement with said first surface of said wall;

(b) pressure imparting means operably associated with said wall engaging means for moving said sealing surface into sealable engagement with the first surface of the wall, said pressure imparting means comprising:

(i) an elongated threaded tubular member having an internal passageway and first and second ends; said second end including finger-gripping means comprising a finger-gripping member comprising a generally V-shaped member having opposing finger engaging surfaces for gripping engagement by the user to resist rotational movement of said elongated tubular member;

(ii) a first locking element carried within said internal passageway of said tubular member and extending outwardly from the first end thereof for inserting into the aperture provided in the wall;

(iii) an outwardly extending second locking element carried within said internal passageway of said tubular member for insertion into the aperture provided in the wall and for movement from a first position to a second position for engagement with the second surface of the wall; and (iv) sealing member engagement means threadably connected to said tubular member for rotational movement from a first position to a second position in engagement with said rigid surface of said sealing member to urge said yieldably deformable surface of said sealing member into pressural engagement with the first surface of the wall when said second locking element is in said second position, said sealing member engagement means comprising a nut having an internally threaded hub portion and a pair of oppositely disposed, outwardly extending wings grippable by the user for imparting rotational movement of said hub portion.

2. An apparatus for sealably closing an aperture provided in a wall having spaced-apart first and second surface, comprising:

(a) wall engaging means for sealably engaging the first surface of the wall at a location surrounding the aperture, said wall engaging means comprising a sealing member having an aperture therethrough and including a first rigid surface and a second yieldably deformable surface for engagement with said first surface of said wall;

(b) pressure imparting means operably associated with said wall engaging means for moving said sealing member into sealable engagement with the first surface of the wall, said pressure imparting means comprising:

(i) an elongated threaded tubular member having an internal passageway and first and second ends, said second end including finger gripping means disposed proximate said second end of said tubular member for engagement by the fingers of the user to grip the apparatus, said finger gripping means comprising a generally V-shaped member having opposing finger engaging surfaces;

(ii) a first locking element comprising an elongated rod carried within said internal passageway of said tubular member and extending outwardly from the first end thereof for inserting into the aperture provided in the wall;

(iii) an outwardly extending second locking element comprising an elongated rod carried within said internal passageway of said tubular member, said elongated rod having a first end for insertion into the aperture provided in the wall and a second end for use in moving said first end from a first position to a second position for engagement with the second surface of the wall; and (iv) sealing member engagement means threadably connected to said tubular member for rotational movement from a first position to a second position in engagement with said rigid surface of said sealing member to urge said yieldably deformable surface of said sealing member into pressural engagement with the first surface of the wall when said second locking element is in said second position, said sealing member engagement means comprising a nut having an internally threaded hub portion and a pair of oppositely disposed, outwardly extending wings grippable by the user for imparting rotational movement to said hub portion.

* * * * *